US009615649B2

(12) United States Patent
Melling et al.

(10) Patent No.: US 9,615,649 B2
(45) Date of Patent: Apr. 11, 2017

(54) HYDRATION DISPENSING DEVICE

(71) Applicant: Raymond Bradley Melling, Manhattan, MT (US)

(72) Inventors: Raymond Bradley Melling, Manhattan, MT (US); Ross Forrest Walker, Helena, MT (US); David J. Yakos, Helena, MT (US)

(73) Assignee: Raymond Bradley Melling, Manhattan, MT (US)

( * ) Notice: Subject to any disclaimer, the term of this patent is extended or adjusted under 35 U.S.C. 154(b) by 0 days.

(21) Appl. No.: 14/319,933

(22) Filed: Jun. 30, 2014

(65) Prior Publication Data

US 2015/0374107 A1 Dec. 31, 2015

(51) Int. Cl.
*B67D 7/84* (2010.01)
*A45F 3/16* (2006.01)

(52) U.S. Cl.
CPC ..... *A45F 3/16* (2013.01); *A45F 2003/166* (2013.01)

(58) Field of Classification Search
CPC . B65D 47/20–47/2037; A41D 2400/46; B67D 2210/00131; A45F 2003/166; B05B 7/1413; B05B 7/1427; B05B 7/2402; B05B 7/2475; B05B 9/08
See application file for complete search history.

(56) References Cited

U.S. PATENT DOCUMENTS 4,090,650 A * 5/1978 Gotta ..... B65D 47/2037 215/11.1
4,139,130 A * 2/1979 Glusker ..... A45F 3/16 2/312
4,544,087 A * 10/1985 Modig ..... A45F 3/16 224/148.2
4,688,643 A * 8/1987 Carter ..... B05B 9/0426 169/33
5,020,725 A * 6/1991 Waldrum ..... A01M 7/0028 222/175
5,104,016 A * 4/1992 Runkel ..... B62J 11/00 222/105
5,246,167 A * 9/1993 Mahon ..... A01M 7/0028 239/154
5,400,934 A * 3/1995 Ducros ..... A45F 3/04 128/202.15

(Continued)

*Primary Examiner* — Paul R Durand
*Assistant Examiner* — Randall Gruby
(74) *Attorney, Agent, or Firm* — MacBride Law, PLLC; William L. MacBride, Jr.

(57) ABSTRACT

The invention is directed to an improved hydration dispensing device and method for preventing the freeze-up of the hydration line, to dispense potable fluids, such as water, from the hydration dispensing device, eliminating freezing by routing the line under the user's clothes with the line accessible section and extending beyond user's cuff, to be accessible at any time. The device and method comprise a remotely actuated valve mechanism adapted worn and remotely actuated, having a valve means for controlling the flow of potable fluid through the mechanism and a shell, defining an interior cavity, providing a valve seat projecting into the interior cavity, adapted to cooperatively seat the valve means, and operationally adapted to selectively open and close a hydration line when operated. The hydration line attaches to a hydration reservoir, or pack liquid-filled bladder, containing the potable fluid.

5 Claims, 10 Drawing Sheets

(56) References Cited

U.S. PATENT DOCUMENTS 5,427,290 A * 6/1995 Thatcher ..... A45F 3/04 224/148.2
5,595,343 A * 1/1997 Marhelko ..... B05B 7/2416 239/154
5,722,573 A * 3/1998 Carnel ..... A45F 3/16 224/148.2
5,984,145 A * 11/1999 McAllister ..... A45F 3/16 222/175
6,199,729 B1 * 3/2001 Drzymkowski ..... A45F 3/20 138/120
6,220,490 B1 * 4/2001 O'Hara ..... A45F 3/16 2/102
6,415,960 B1 7/2002 Fink et al.
6,598,770 B2 * 7/2003 Bolts ..... A45F 3/00 224/148.2
6,651,694 B1 11/2003 Krenzel et al.
7,478,768 B2 1/2009 Yip
7,820,946 B2 10/2010 Woodfill et al.
8,167,177 B1 5/2012 Galgano
8,276,789 B2 10/2012 Emenheiser
8,453,893 B2 * 6/2013 Shitaye ..... A45F 5/00 224/148.2
8,604,392 B1 * 12/2013 Ostrom ..... A45F 3/20 219/214
8,640,925 B1 * 2/2014 Schwegman ..... A01C 15/02 222/175
8,839,996 B2 * 9/2014 Parazynski ..... A45F 3/16 224/148.2
2002/0124294 A1 * 9/2002 McKenzie ..... A41D 13/0002 2/69
2003/0075573 A1 * 4/2003 Bailey ..... A45F 3/20 224/148.2
2004/0079517 A1 * 4/2004 Bueley ..... A41D 13/0053 165/46
2004/0262331 A1 * 12/2004 Woolfson ..... A45F 3/20 222/145.5
2005/0029313 A1 * 2/2005 Robins ..... A45F 3/20 222/490
2005/0034476 A1 * 2/2005 Pohr ..... A41D 13/0055 62/420
2006/0080756 A1 * 4/2006 Goldfine ..... A41D 13/0051 2/102
2006/0151534 A1 * 7/2006 Mares ..... A45F 3/04 222/175
2006/0191049 A1 * 8/2006 Elkins ..... A41D 13/0053 2/7
2008/0185408 A1 * 8/2008 James ..... A45F 3/20 224/148.2
2009/0095773 A1 * 4/2009 Pinne ..... A45C 15/00 222/146.2
2010/0116848 A1 5/2010 Powers
2011/0036861 A1 2/2011 Hillel et al.
2011/0101050 A1 5/2011 Parazynski et al.
2011/0113524 A1 * 5/2011 Sinder ..... A45F 3/20 2/93
2012/0048898 A1 3/2012 Franklin et al.
2013/0263398 A1 * 10/2013 Irwin ..... A47L 13/22 15/228
2014/0013481 A1 * 1/2014 Lee ..... A41D 15/04 2/69
2015/0001253 A1 * 1/2015 Slaton ..... A45F 3/16 222/144.5

* cited by examiner

HYDRATION DISPENSING DEVICE

FIELD OF THE INVENTION

This invention relates to a hydration dispensing device or apparatus and method for preventing the formation of frost or ice within the hydration or water line to a hydration pack/bladder of potable fluids, such as water, and significantly modify conventional hydration dispensing devices known in the industry.

BACKGROUND OF THE INVENTION

The market has numerous devices to dispense potable fluids, such as water, from a hydration dispensing device, such as a hydration pack or bladder, in the hydration line. Existing hydration packs or dispensing devices have limitations for use in freezing weather, and fail to eliminate freezing in a hydration line or tube, preventing the fluid from being accessible to the user at any time, frustrating a thirsty hiker or other user who finds that the water or other potable fluid is inaccessible because the (what was thought) convenient access to the potable liquid is now frozen.

While the market has many hydration, insulation kits to delay freeze-up, none of the current devices prevent freeze-up entirely. None provide an efficient source of hydration protected from freezing conditions, with great convenience, while maintaining a continual source for hydration. The current devices do not eliminate freeze-ups or incorporate the increased convenience of having the hydration supply literally "at your fingertips" as in the invention, which may be used by the user merely by raising his or her wrist to the mouth and allowing the potable fluid to flow.

Existing products, as well, frequently have hydration lines that dangle awkwardly at the user's chest. Conventional bladder tubes and other hydration dispensing devices come with a supply line or tube placed over the user's shoulder. While convenient for drinking, the current devices dangle inconveniently against the user's body, swinging in an unsecured and uncontained manner during hiking or other activities, and in particular, striking the users' hands as they run.

There are products designed to insulate the supply lines and tubes which insulation, while somewhat effective, only slows the heat loss. With no source of heat, these products merely delay the inevitable freeze-up in the line. During extreme cold conditions, where hydration can be extremely important (such as at high altitudes where altitude sickness is a concern), products relying on insulation can be ineffective.

Other hydration pack products may attempt to provide convenience by having the hydration supply available to the user with a bite or squeeze valve on the end of the bladder or hydration line, but such valves are located inconveniently at the collar of a coat, accessed through the buttons or zipper of the coat. These products require the user exposing his or her self to the elements by removing a glove, zipping down the coat every time he or she wants a sip of water. A tactic currently used to prevent freeze-up in current devices involves users blowing air back into the hydration line. While effective in certain systems, this can introduce bacteria in the line.

Certain related art patent references disclose various types of hydration dispensing devices which teach or disclose individual features, but not all the features of the invention. For example, U.S. Pat. No. 8,276,789 to Emenheiser ("'789 patent") discloses ball valves within the hydration lines. As well, U.S. Pat. No. 8,167,177 to Galgano ("'177 patent") and U.S. Patent Application #2012/0048898 to Franklin et al. ("Franklin") each teach valves positioned on the wrist or hand of a user. U.S. Patent Application #2011/0113524 to Sinder ("Sinder") teaches passive heating to prevent freezing of the hydration line. However, no single reference found discloses all such features as well as the other features of the proposed invention.

While various references may suggest combinations in some respects, none of these references disclose all the features in combination therewith in the manner set forth in this invention. For example, none of the references teach or disclose a dedicated hydraulic line filled with an antifreeze fluid for actuating a ball valve as in the remotely actuated, or activated, valve mechanism of the invention. As well, none of the references teach a squeeze or bite bulb at the drinking end of a hydration line or tube to be used for actuating the hydration valve in any conventional hydration dispenser. A ball shaped device disclosed in the '789 patent, while disposed remotely from the drinking end of the hydration tube, appears to be a hand pump rather than a valve actuator as found in this invention. None of the related art references disclose, teach, or suggest all of the features of this invention.

None of the cited devices herein disclose modifying a hydration line or the actuating mechanism of a conventional hydration dispensing device in the manner set forth in this invention. Therefore, as noted, none of the references contain every feature of the invention, and none of these references in combination disclose or teach every feature of the invention.

The foregoing and other objectives, advantages, aspects, and features of the invention will be more fully understood and appreciated by those skilled in the art upon consideration of the detailed description of an embodiment, presented below in conjunction with the accompanying drawings.

SUMMARY OF THE INVENTION

The invention is directed to an improved hydration dispensing device and method for preventing the freeze-up of the hydration line, as a device to dispense potable fluids, such as water, from a dispensing device, such as a hydration bladders free of frost in the hydration line. The invention improves existing hydration bladders or dispensing devices for use in freezing weather, eliminating freezing in a hydration line or tube by routing the line under the user's clothes with a drain accessible section and extending beyond user's cuff, to be accessible at any time.

The device of an embodiment of the invention comprises a remotely actuated valve mechanism which is adapted to be worn and remotely actuated by a user of the hydration dispensing device The remotely actuated valve mechanism has a valve means and method for controlling the flow of potable fluid through the valve mechanism and a mechanism shell, the outer casing of said valve mechanism, defining an interior cavity which contains the inner parts.

The valve means in alternative embodiments may be any number of valves common in the industry as understood by those skilled in the art to control or regulate the flow of the potable fluid, such as a spring-biased ball or globe valve adapted to selectively open and close a hydration line, a "pull-on, push-off" type of valve, or a twist valve having a ball or 'butterfly' element, or other type of valve means.

The mechanism shell provides a valve seat projecting into the interior cavity, adapted to cooperatively seat the valve means. In one aspect of the invention the interior cavity contains a valve means is operationally adapted to selectively open and close a hydration line of port at the valve seat against which the valve means. The hydration line acts as the passage that allows potable fluid to pass through the remotely actuated valve mechanism when said valve mechanism is opened at the valve means. The hydration line attaches to a hydration reservoir, pack liquid-filled bladder, containing the potable fluid. The hydration reservoir provides potable fluid pressure within the hydration line to cause the potable fluid to flow within the hydration line to the exposed end.

The invention adopts an efficient source of and method for hydration protected from freezing conditions, with great convenience, while maintaining a continual source of hydration. The improvement of the invention eliminates freeze-ups, and it incorporates increased convenience by having the hydration supply literally "at your fingertips". The device and method can be used by the user merely by raising his wrist to the mouth, gently biting or squeezing the bulb, allowing the potable fluid to flow, a distinct advantage over existing products that dangle awkwardly at your chest.

As well, the potable fluid supply line of the invention is discretely contained, and protected from the cold and elements, within clothing, such as in the sleeve of a coat or other clothes of the user. The bulk of the hydration line harnesses to the user to keep the line warm, while the exposed portion of the line can be quickly and easily cleared of fluid preventing freeze-up.

Conventional bladder line, hose or tubes and other hydration dispensing devices come with the supply line or tube placed over your shoulder. While convenient for drinking, the current devices dangle inconveniently against the user's body, swinging in an unsecured and uncontained manner during hiking or other activities, and in particular, striking the users' hands as they run. There are products designed to insulate the supply lines and tubes. While somewhat effective, insulation only slows the heat loss. With no source of heat, these products merely delay the inevitable freeze-up in the line. During extreme cold conditions, where hydration can be extremely important (such as at high altitudes where altitude sickness is a concern), products relying on insulation can be ineffective.

One embodiment of the invention comprises a valve means that can be opened by hydraulic pressure, actuated by biting or squeezing a bulb full of edible antifreeze and a line that can be drained using a means clearing potable fluids, such as a straw or drain.

In one aspect of the invention, the remotely actuated valve would leave the mouth piece exposed, and place the value in a protected location toward the end of the hydration tube, incorporating a small air vent near the mouth piece, outside of clothing, providing a measured method to allow the user to shut-off the water and clear the line past the valve.

An advantage of the invention is that it overcomes the freeze-up problem in the hydration line by insulating the line in the user's clothes, such as the sleeve of the user's coat, and heating the line with the passive heat of the user's body. The users' own body heat provides the source of heat necessary to prevent freezing, rather than merely delaying it with current devices.

Another advantage of the invention is that it eliminates the need for the user to blow air back into the hydration line, to clear the line of water and prevents freezing, thereby preventing the introduction of bacteria into the line and the water supply.

Another advantage of the present invention is that inside the hydration line is the means for clearing potable fluid, such as a "clearing straw", a small tube that extends slightly past the end of the hydration line and functions like a straw, to draw all the hydration fluid located past the valve in an exposed line, in order to prevent freezing.

An objective of the invention is to provide a convenient means of and method for using the device, placing a squeeze bulb at the user's wrist, where it can be accessed quickly, and without removing any clothing. The rest of the delivery system of the potable fluid in routed securely, neatly, and comfortably inside clothing, such as the sleeve or other clothes on the user.

Another advantage of the invention is that its delivery tube, or hydration line is long enough to route over the user's shoulder and through the coat sleeve, resting comfortably, on the inside of the coat where the body bends. An advantage of the invention is that it never is pressed against stretched fabric of the coat when the user's arm is bent, and is therefore never an annoying presence.

The invention provides a means and method for access to the potable fluid such as water without exposing the user to the elements by removing gloves or undoing the coat. There is no interruption of the user's winter activities.

In another embodiment, the end of the hydration line contains at least one nozzle. The bulb can be squeezed with the fingers allowing water to squirt out from the end of the line, to facilitate sharing with a friend and increasing the force of the flow.

The aforementioned features, objectives, aspects and advantages of the invention, and further objectives and advantages of the invention, will become apparent from a consideration of the drawings and ensuing description.

BRIEF DESCRIPTION OF THE SEVERAL VIEWS OF THE DRAWINGS

The foregoing features and other aspects of the invention are explained, and other features and objects of the invention will become apparent, in the following detailed descriptions taken in conjunction with the accompanying drawings. However, the drawings are provided for purposes of illustration only, and are not intended as a definition of the limits of the invention.

DETAILED DESCRIPTION OF THE INVENTION

The invention will now be described more fully hereinafter with references to the accompanying drawings, in which the preferred embodiment of the invention is shown. This invention may, however, be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout.

Figure 1:
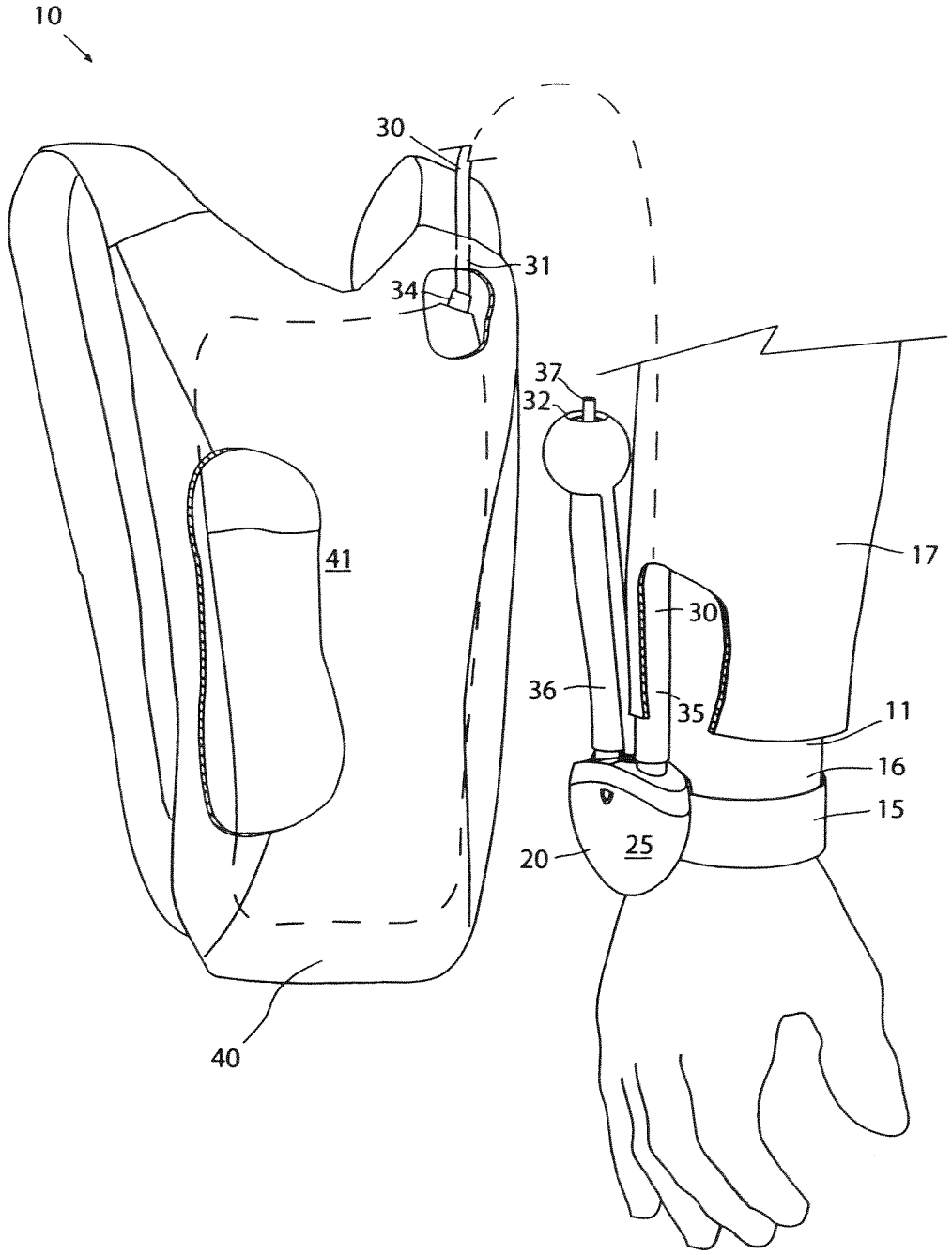
FIG. 1 illustrates a perspective view of one embodiment of the invention, comprising the hydration dispensing device, depicting cut-out views of the interior of the hydration reservoir or pack.

Turning now in detail to the drawings in accordance with the invention, one embodiment of the invention is depicted in FIG. 1, a perspective view of a hydration dispensing device 10, said device 10 comprising a remotely actuated valve mechanism 20 which is adapted to be worn under a user's clothes 17 and remotely actuated by a user 11 of the hydration dispensing device 10.

Figure 2:
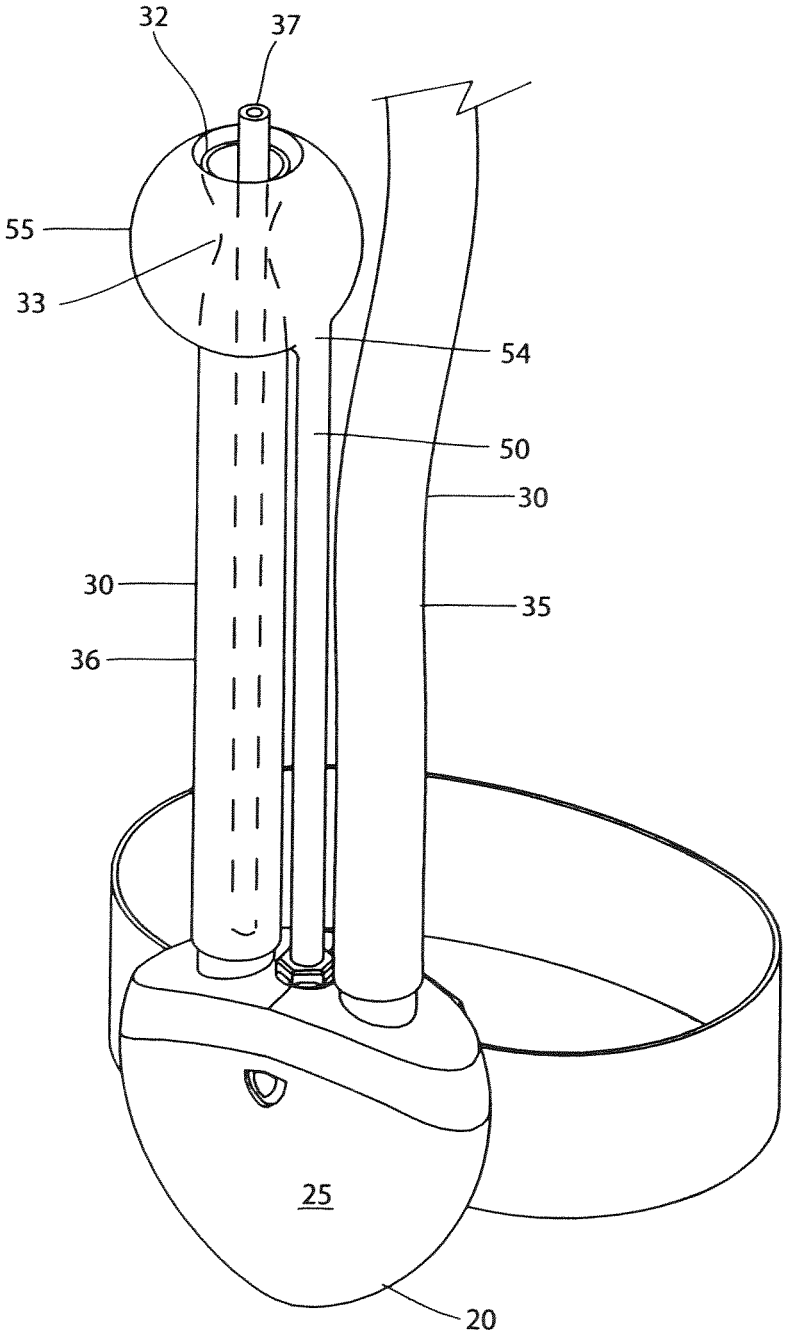
FIG. 2 illustrates a partial, elevated perspective view of the hydration line and a remotely actuated valve mechanism in one embodiment of the invention, excluding the hydration reservoir.
Figure 4:
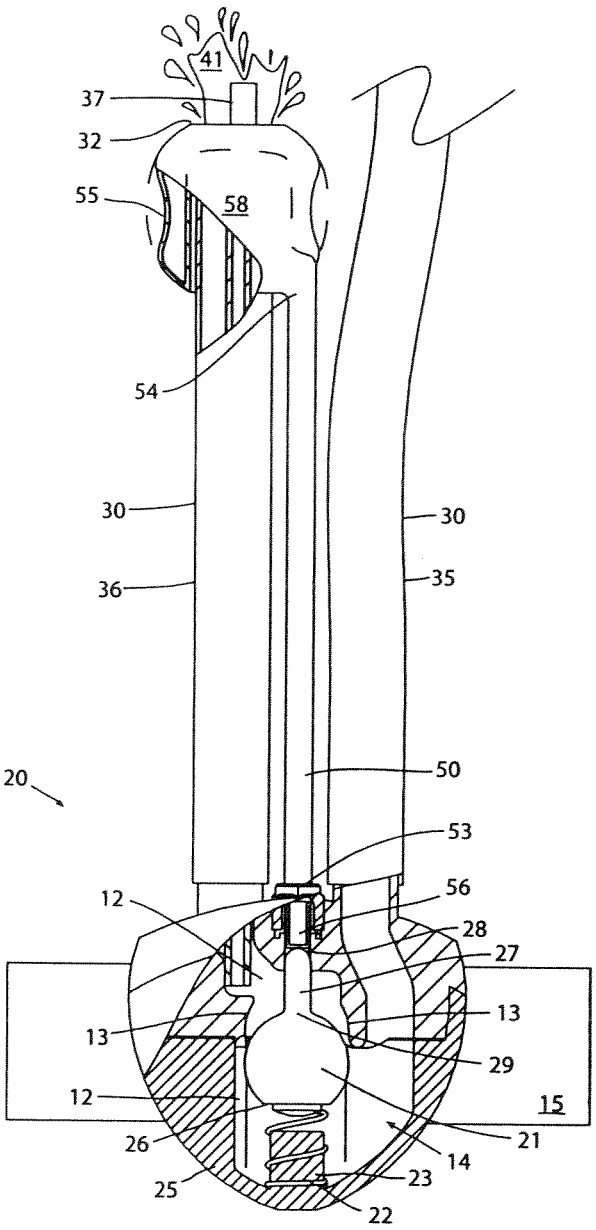
FIG. 4 illustrates an elevated front view of the hydration line in FIG. 2, with partial cut-out and cross-sectional views of the hydration line and the remotely actuated valve mechanism to one embodiment of the invention, depicting the squeeze or bite bulb squeezed and delivering potable fluid to the user.
Figure 5:
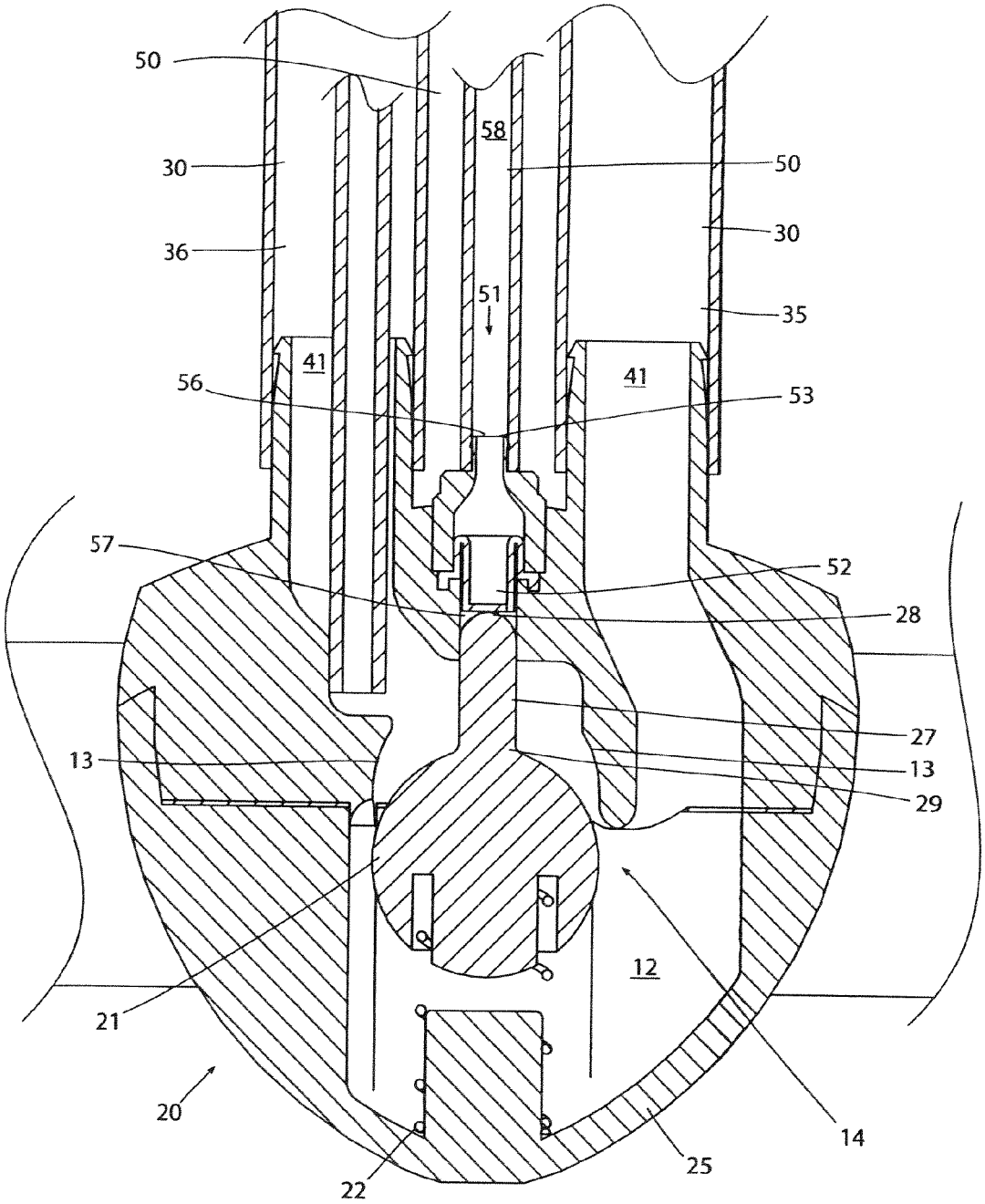
FIG. 5 illustrates an enlarged, elevated, and front cross-sectional view of the remotely actuated mechanism in one embodiment of the invention, depicting the potable fluid location within the hydration line, the direction of fluid pressure within the dedicated hydraulic line and the valve means in an open position in this embodiment.
Figure 6:
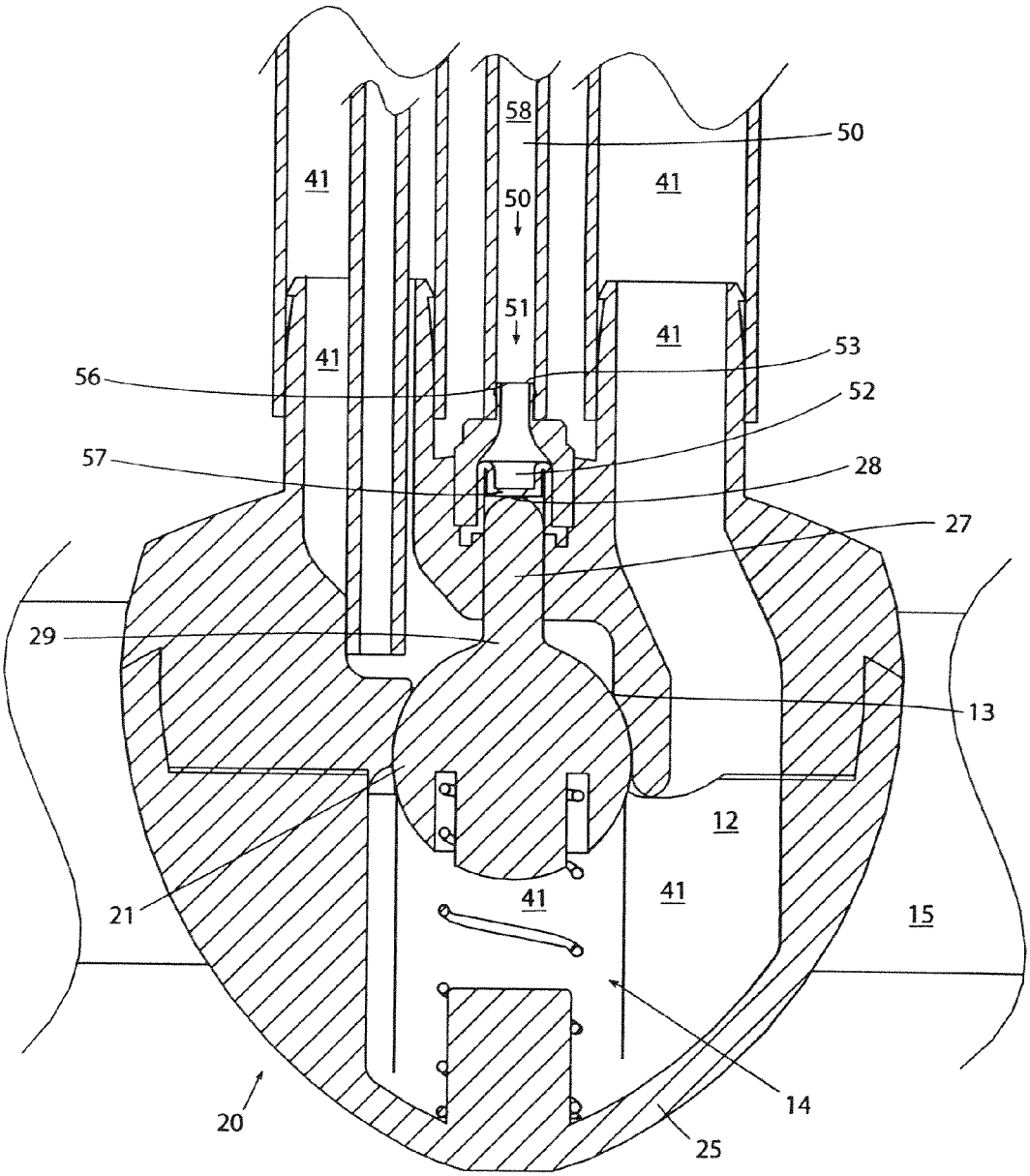
FIG. 6 illustrates an enlarged, elevated, and front cross-sectional view of the remotely actuated mechanism in one embodiment of the invention, depicting the potable fluid location within the hydration line, the direction of fluid pressure within the dedicated hydraulic line and the valve means in a closed position in this embodiment.

Shown in FIG. 1, and in FIG. 5 and FIG. 6, which have enlarged, elevated, and front cross-sectional views, the remotely actuated valve mechanism 20 has a valve means 14 for controlling the flow of potable fluid 41 through the valve mechanism 20 and a mechanism shell 25, or body. As well, FIG. 2 illustrates a partial, elevated perspective view of the valve mechanism 20 and a hydration line 30, tube or hose. The mechanism shell 25, the outer casing of said valve mechanism 20, defines an interior cavity 12, which contains the inner parts or trim, as further depicted in FIG. 3, an exploded, elevated perspective view, and in FIG. 4, an elevated, front view of FIG. 2 with a partial cut-out. In one embodiment, shown in FIG. 3, the mechanism shell 25 may comprise two parts having a gasket 24 where the two parts join.

Figure 3:
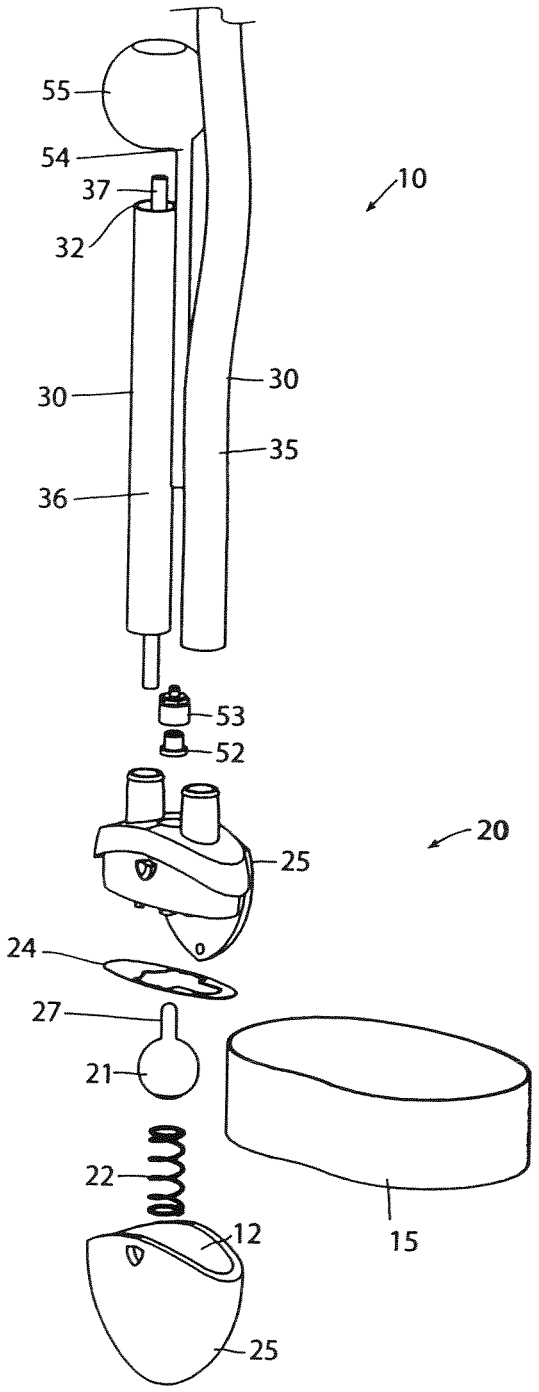
FIG. 3 illustrates an exploded, elevated prospective view of the hydration line and remotely actuated valve mechanism in one embodiment of the invention.
Figure 8:
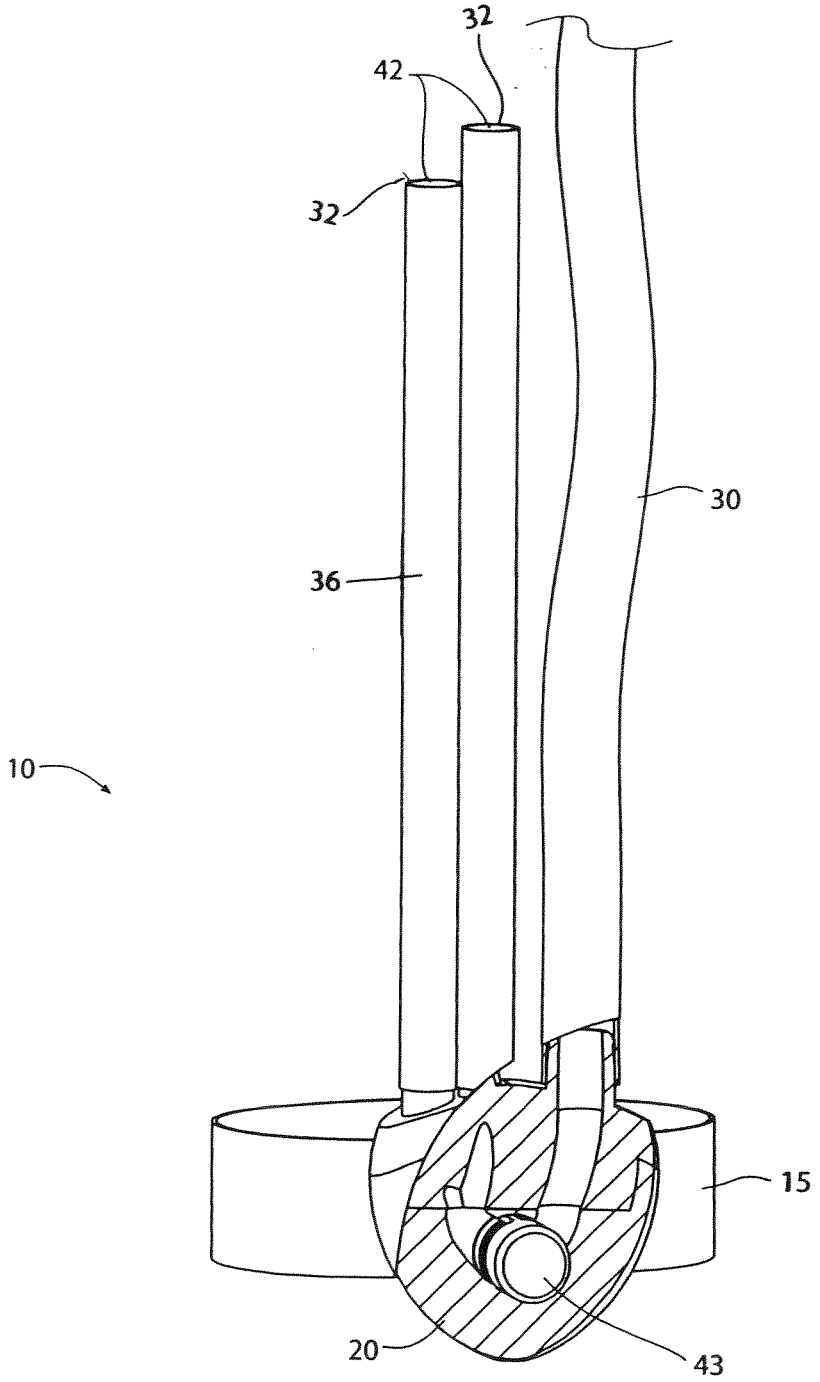
FIG. 8 illustrates a partial, elevated perspective view of the hydration line and a remotely actuated valve mechanism in another embodiment of the invention, providing the two-tube or cannula as a means for clearing potable fluid in the hydration line, and cutout of a pushbutton, one-way valve to the hydration line as a valve means for controlling the flow of potable fluid.
Figure 10:
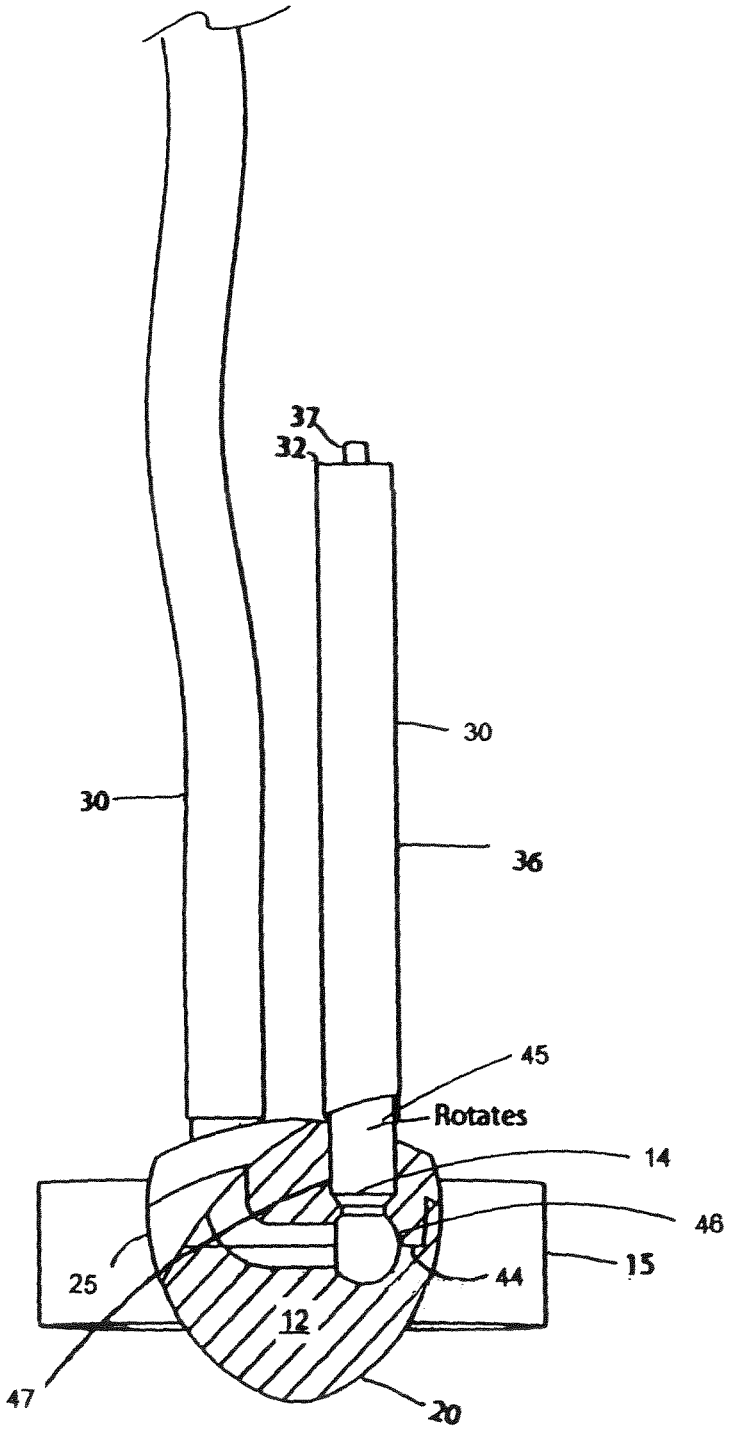
FIG. 10 illustrates a partial, elevated perspective view of the hydration line and a remotely actuated valve mechanism, in another embodiment of the invention, providing a twist valve as a valve means for controlling the flow of potable fluid in the hydration line.

It is contemplated that the valve means 14 may be any number of valves common in the industry as understood by those skilled in the art to control or regulate the flow of the potable fluid 41, such as a spring-biased ball 21 or globe valve adapted to selectively open and close a hydration line 30, as shown in FIG. 3 and FIG. 5; a pushbutton 43 shown in FIG. 8; or a twist valve having a ball or twist element, as shown in FIG. 10; or other type of valve means 14 found in this industry.

The mechanism shell 25 provides a valve seat 13, or ridge, projecting into the interior cavity 12, as shown in FIG. 4, FIG. 5, and FIG. 6; adapted to cooperatively seat the valve means 14. In one embodiment of the invention, depicted in FIG. 4, the interior cavity 12 of said valve mechanism 20 contains the valve means 14, which is operationally adapted to selectively open and close the hydration line 30, at the valve seat 13 against which the valve means 14 is seated (shown in FIG. 4), as part of the remotely actuated valve mechanism 20 when operated. The remotely actuated valve mechanism 20, as shown in FIG. 1 and FIG. 3, is located along, and in fluid regulating communication with, the hydration line 30. In one embodiment, the mechanism 20 may be centrally located along the hydration line 30. The hydration line 30 acts as the passage that allows potable fluid 41 to pass through the remotely actuated valve mechanism 20 when said valve mechanism 20 is opened at the valve means 14.

The hydration line 30, as shown in FIG. 1, attaches to a hydration reservoir 40, such as a pack or a liquid-filled bladder, containing the potable fluid 41. The hydration line 30 has a reservoir end 31 connected to and in liquid communication with the hydration reservoir 40 worn by the user 11 and an opposite exposed end 32 extending outside the user's clothes 17. Said valve mechanism 20 thereby controls the flow of potable fluid 41 through the hydration line 30. The hydration pack 40 provides potable fluid pressure within the hydration line 30 to cause the potable fluid 41 to flow within the hydration line 30 to the exposed end 32. The hydration line is made of a flexible, liquid impermeable material.

In an embodiment of the invention, shown in FIG. 5 and FIG. 6, the valve means 14 comprises a spring-biased ball 21, biasedly seated against the valve seat 13 (in FIG. 6) within the remotely actuated valve mechanism 20 when said valve mechanism 20 is closed, providing a leak-tight seal. Said ball 21 is a movable obstruction to the invention inside the stationary mechanism shell 25, or body, that adjustably controls flow of the potable fluid 41 through the valve mechanism 20 and the hydration line 30. As further shown in FIG. 3 and FIG. 4, the spring-biased ball 21 has a spring 22 anchored to the mechanism shell 25 at a first end 23 and disposed against the spring-biased ball 21 at an opposite second end 26 to the ball 21. A pushrod 27 is securely located against the valve means 14, depicted as the spring-biased ball 21 in FIG. 4 and FIG. 5, at a rod side 29 to said valve means 14, circumferentially opposite the spring 22, the pushrod 27 having a diaphragm end 28 opposite the rod side 29.

Shown in FIG. 4, FIG. 5, and FIG. 6, a dedicated hydraulic line 50 is adapted in the invention to selectively exert hydraulic fluid pressure 51 (in FIG. 6) against a diaphragm 52 disposed at a mechanism end 53 of the hydraulic line 50. The hydraulic line 50 has an opposite engaged end 54 fixedly secured to a squeeze bulb 55, or bite bulb (as shown in FIG. 4). The dedicated hydraulic line 50 sealedly contains hydraulic antifreeze fluid 58. Said antifreeze fluid 58 is sealed within the hydraulic line 50 to prevent communication with the potable fluid 41. The squeeze bulb 55 in the device of the invention remotely controls the valve mechanism 20 from outside the mechanism shell 25, as in FIG. 3 and FIG. 4. The remote actuated hydraulic valve mechanism 20 thereby operates as a valve to stop the flow of hydraulic, potable fluid 41 when required by the user 11.

The hydration line 30 in the invention is disposed adjacent to the user 11, permitting passive heating to the hydration line 30, inhibiting freezing of the potable fluid 41 in the hydration line 30. As show in FIG. 1 the hydration line 30, in one embodiment of the invention, has a heated section 35 which is that portion of the hydration line 30 is disposed adjacent to the user 11. The passive heating is radiantly and absorbedly provided by the adjacent body of the user 11, under the user's clothes 17. The heated section 35 is located between said valve mechanism 20 and the hydration pack 40. The hydration line 30 in such embodiment has an exposed section 36 located between said valve mechanism 20 and the exposed end 32.

In an embodiment, shown in FIG. 4 and FIG. 6, and mentioned above, the valve mechanism 20 utilizes the valve means 14 that comprises the spring-biased ball 21 adapted to selectively open and close the hydration line 30 at the valve seat 13 against which the spring-biased ball 21 is biasedly seated when the valve mechanism 20 is closed (in FIG. 6). The spring-biased ball 21 in this embodiment has the spring 22 anchored to the mechanism shell 25, and the pushrod 27 is securely located against the spring-biased ball 21 at the valve means 14 rod side 29 which is circumferentially opposite the spring 22.

The valve means 14 is in actuating, cooperative relation with the hydration line 30 to allow potable fluid 41 to move from the hydration reservoir 40 through the actuated valve mechanism 20 and out the exposed end 32; and in an embodiment, as shown in FIGS. 5 and 6, the pushrod 27 at the rod side 29 is in cooperative relation with the spring-biased ball 21 causing said ball 21 to move against the spring 22 unseating said ball 21 away from the valve seat 13, actuating the valve mechanism 20. The spring-biased ball 21 as the valve means 14 is pressed against the valve seat 13 when closed, and hydraulic fluid pressure 51 generated from the squeeze bulb 55, remotely opens the valve mechanism 20, as the open and closed positions are depicted in FIG. 5 and FIG. 6, respectively, allowing potable fluid 41 to move through the actuated value mechanism 20 into the exposed section 36 of the hydration line 30 and out the exposed end 32.

As further depicted in FIG. 5 and FIG. 6, the hydraulic antifreeze fluid 58 flows into the valve mechanism 20 along the dedicated hydraulic line 50, that is sealed on its diaphragm end 28 with the flexible diaphragm 52. As shown in FIG. 5 and FIG. 6, the diaphragm 52 has a hydraulic side 56 operatively disposed within the mechanism end 53 of the hydraulic line 50 and an opposite pressure side 57 cooperatively engaging the pushrod 27 at the diaphragm end 28. As depicted in FIG. 5, the hydraulic line 50 is in pressure exerting, actuating relation against the hydraulic side 56 of the diaphragm 52 when the squeeze bulb 55 is compressed by the user 11 (see FIG. 4). The squeeze bulb 55 causes the antifreeze fluid 58 in the hydraulic line 50 to exert the hydraulic pressure 51 against the diaphragm 52. The diaphragm, in turn, being in yielding relation at the pressure side 57 and pressure-exerting, actuating relation against the pushrod 27 at the diaphragm end 28, yields to the hydraulic pressure 51 by actuating and exerting pressure against the pushrod 27 at the diaphragm end 28, see FIG. 5 showing the diaphragm 52 in contrast to FIG. 6. This diaphragm 52 responds to the fluid pressure 51 from the hydraulic antifreeze fluid 58, and flexes and expands to move the pushrod 27. The pushrod 27 is securely seated and rests against the valve means 14. When the diaphragm 52 is expanded from the hydraulic fluid pressure 51, as shown in FIG. 6, the pushrod 27 will open the actuated valve mechanism 20 by pushing the valve means 14, the spring-biased ball 21 shown in FIG. 5 and FIG. 6, off of the valve seat 13, allowing potable fluid 41 to flow through the hydration line 30 from the heated section 35 to the exposed section 36 and to the user 11 (as shown in FIG. 2). As depicted in FIG. 6, the pushrod 27, being in cooperative relation at the rod side 29 with the valve means 14, unseats the valve means 14 from the valve seat 13, thereby remotely actuating or activating the valve mechanism 20, allowing potable fluid 41 to move through the actuated value mechanism 20 into the exposed section 36 of the hydration line 20 and out the exposed end 32. In function and structure then, the actuated valve mechanism 20, in remotely actuating relation, operates in remote relation actuated by the squeeze bulb 55.

When the squeeze bulb 55 is released, the hydraulic antifreeze fluid 58 flows back to the squeeze bulb 55. The fluid pressure 51 is released from the diaphragm 52 at the diaphragm end 28 of the dedicated hydraulic line 50, and the spring 22 on the second end 26 side of said ball 21 will push the ball back against the valve seat 13 (see FIGS. 4-6). In this manner, the flow of hydration, potable fluid 41 is stopped.

Figure 7:
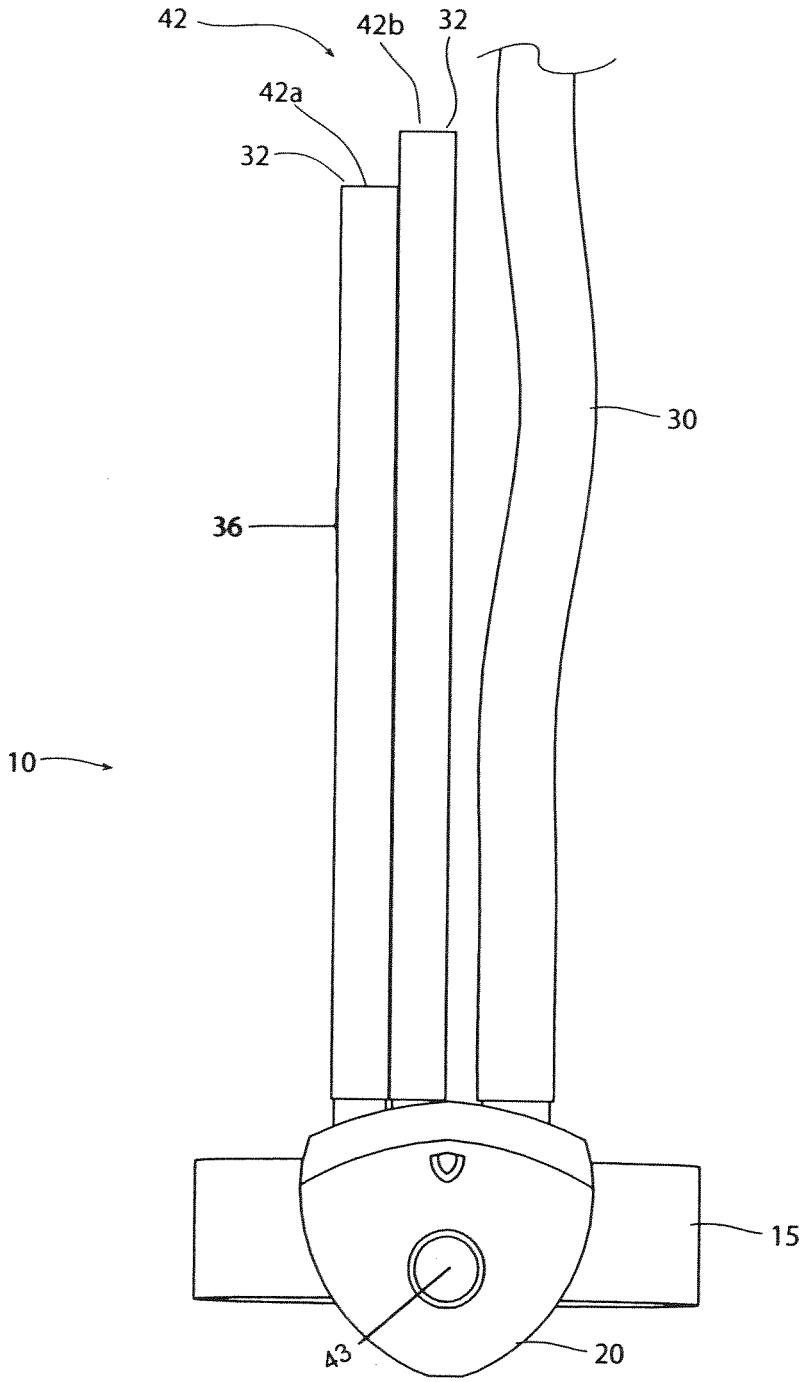
FIG. 7 illustrates a partial, elevated perspective view of the hydration line and a remotely actuated valve mechanism in another embodiment of the invention, providing a two-tube or cannula as a means for clearing potable fluid in the hydration line.

In an alternative embodiment of the invention, the remotely actuated valve mechanism 20, shown in FIGS. 7 and 8, may be operated by the user 11 pushing, pinching or squeezing the pushbutton 43 to operate as the valve means 14, without the use of the dedicated hydraulic line 50. The remotely actuated valve mechanism 20 comprises the same mechanism shell 25 and other elements defined above with the valve means 14 operationally adapted to selectively open and close the hydration line 30 when the actuated valve mechanism 20 is operated; and the mechanism shell 25 operatively disposed to yield in pressure exerting, actuating relation against the valve means 14 when the mechanism shell 25 is compressed by the user 11 unseating the valve means 14 from the valve seat 13, allowing potable fluid to move through the actuated valve mechanism 20 into the exposed section 36 of the hydration line 30 and out the exposed end 32. The mechanism shell 25 in this embodiment is made of cooperatively yielding material, acting to push the spring-biased ball 21 off of the valve seat 13, allowing potable fluid 41 to flow through the hydration line 30 from the heated section 35 to the exposed section 36 and to the user 11. The squeezing or pinching pressure may be supplied by the user by a pinch horizontally across the valve means 14 or a squeeze of the valve means 14 against the user's wrist 16.

The hydration line 30 contains a means for clearing potable fluid 37 from the hydration line 30, such as, in one embodiment, an open-ended clearing straw, or drain, shown in FIGS. 1-3 and 4 and 9, whereby said means 37 runs proximally from the remotely actuated value mechanism 20 and out the exposed end 32 of the hydration line 30. The means for clearing potable fluid 37 allows the user 11 to clear unconsumed potable fluid 41 from the exposed section 36 of the hydration line 20, thereby preventing freezing from occurring in the exposed section 36 when the hydration dispensing device 10 is not in use.

Another embodiment of the invention has the hydration line 30, within the exposed section 36, comprising a cannula 42, or other tube arrangement, consisting of two tubes or spouts, preferably of slightly uneven lengths (42*a* and 42*b*) depicted in FIGS. 7 and 8 as the means for clearing potable fluid 37 out of the hydration line 30 from the valve mechanism 20 through the exposed end 32. When the valve means 14 is open, as in FIG. 5, both of the tubes (42*a* and 42*b*) to the cannula 42 supply the potable fluid 41. When the valve means 14 is closed, as in FIG. 6, the user 11 may draw on one tube of the cannula 42 and leave the other tube open to the outside at the exposed end 32, allowing air to enter the open tube of the cannula 42. The user 11, thereby draws the potable fluid 41 first from the open tube 42*a* or 42*b*, then the valve means 14 and finally, from the closed tube (the respectively alternative 42*a* or 42*b*) of the cannula 42. Once done drinking, the user 11, by using one of the tubes 42*a* or 42*b*, can drink the rest of the fluid 41 remaining in both the drinking tubes 42*a* and 42*b*, removing all potable fluid 41 from the environmentally exposed sections 36 on the tubes 42*a* and 42*b*.

Figure 9:
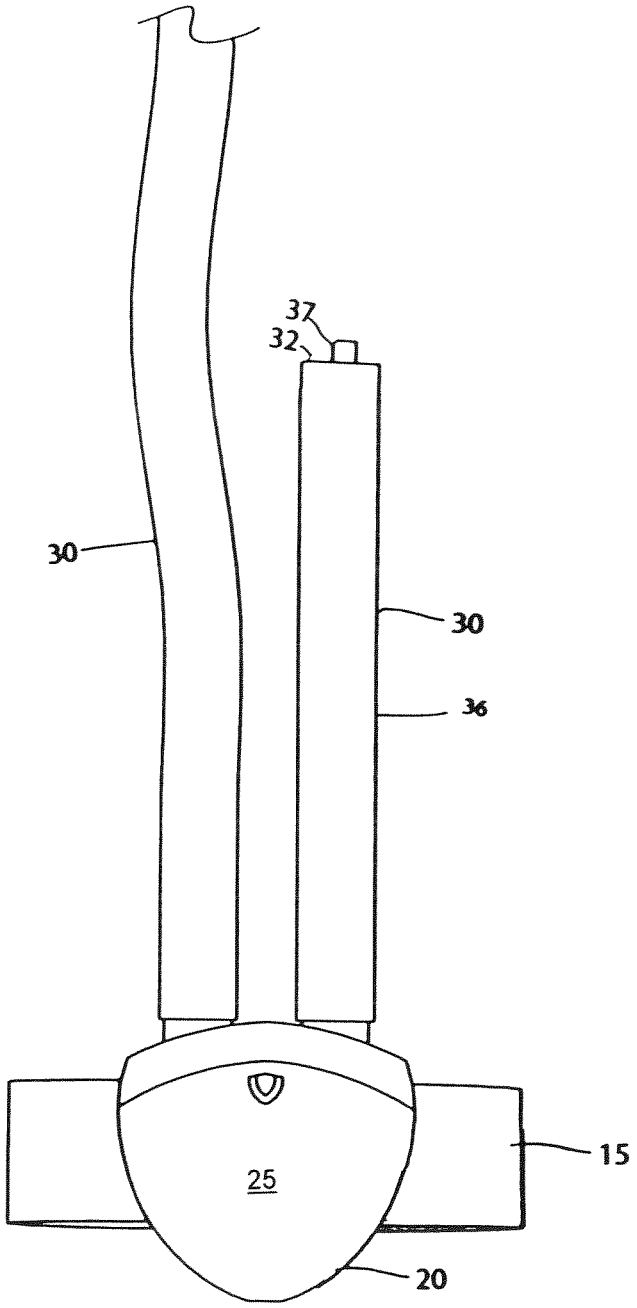
FIG. 9 illustrates a partial, elevated perspective view of the hydration line and a remotely actuated valve mechanism in another embodiment of the invention, a single tube to use with a clearing straw, for clearing potable fluid in the hydration line.

In another embodiment, shown in FIG. 8, the hydration line 30, within the valve means 14, further comprises the pushbutton 43 which may be used with the cannula 42 two tube arrangement depicted in FIGS. 7 and 8 or in a single tube shown in FIG. 9. The pushbutton valve 43 acts as a valve means 14 operated in the mechanism shell 25 of the valve mechanism 20.

In another embodiment of the invention, depicted in FIG. 10, the remotely actuated valve mechanism 20 comprises: the mechanism shell 25 defining the interior cavity 12 and providing a socket 44 projecting into the interior cavity 12 adapted to cooperatively seat the valve means 14. The valve means 14 is operationally adapted to selectively open and close the hydration line 30 at the socket 44 against which the valve means 14 is seated when the actuated valve mechanism 20 is operated. The valve means 14 comprises: a twist valve 45, which has a hollow ball 46 having a hole 47 through the hollow ball 46 and connectively and operatively attached to the hydration line 30. Potable fluid 41 passes through the mechanism 20 when the hollow ball 46 is turned one quarter, or "rotated" as indicated on FIG. 10, aligning the hole 47 with the hydration line 30, and the potable fluid 41 is restricted when the hollow ball 46 is subsequently turned, or rotated, one quarter, thereby using the twist valve 45 for controlling the flow of potable fluid 41. A clearing straw is used as the means for clearing the potable fluid 37 from the exposed section 36 of the hydration line 30, from the remotely actuated value mechanism 20 and through the exposed end 32, to prevent freezing.

The hydration reservoir 40, or pack, shown in FIG. 1, can be a number of commonly used hydration packs, bladder bags, bladder-like hydration packs, reservoirs or other forms, contemplated hereby, as understood by these skilled in the art, and used by a hydration dispensing device 10, that contains the potable fluid 41 meant for consumption by the user 11. The hydration dispensing mechanism 10 is designed to be compatible with any hydration pack 40 in the market, including pressurized hydration pack systems, such as Geigerrig®, as well as more conventional hydration pack systems. Some hydration packs 40 incorporate a system for pressurizing this reservoir, that, when combined with a valve means 14 provide running water, as the potable fluid 41. When used with a pressurized hydration pack system, the fluid pressure 51 from hydraulic antifreeze fluid 58 in such embodiments will help the spring 22 press the valve means 14, such as the spring-biased ball 21, into the valve seat 13, helping it to seal and close the valve means 14. All hydration packs 40 have connected to the bottom of the pack a tube that acts as a drain and at the distal end of this tube some type of valve or other mechanism to control the flow of liquid, and an attaching means 34 at the reservoir end 31 for attaching the hydration line 30 to the hydration pack 40. The attaching means 34 may be any number of commonly used mechanisms for securely attaching a line to a pack, bag or reservoir, such as a threaded screw insert, threaded fastener, interlocking fitting, or other sealable connection, as understood by those skilled in the art.

The hydration pack 40, or bladder, from which the hydration line 30 runs at the reservoir end 31, as depicted in FIG. 1, can be worn outside of the user's clothes 17, such as a coat of a user 11, in less extreme conditions, or for shorter periods of time. If worn outside of a coat, in such embodiment, the hydration line 30 can be routed either under the hem of the coat, over the collar, or preferably, in through a "pit zip". Extra insulation can be applied to any exposed section 36 of the hydration line 30, the only part of the hydration line 30 that is vulnerable to freezing. In more extreme conditions, the user could wear the hydration pack 40 under the clothes 17, such as a coat shell and/or fleece, using normal, neoprene style insulation for improved comfort and performance. The hydration line 30 can be routed, as shown in FIG. 1, through portions of the user's clothes 17, such as the sleeve of such a shell, outside of mid-layer insulation, for cold conditions, such as down to about 10 degrees Fahrenheit. For colder conditions, the hydration line 30 may be run against the body of the user 11, closer to the user's body heat and better protected, so it is run inside of user's mid-layer insulation, such as a fleece coat.

As shown in FIG. 2, in other embodiments of the invention, the exposed end 32 of the hydration line 40 comprises at least one nozzle 33. The at least one nozzle 33 acts to accelerate the flow of the potable fluid 41 allowing it to squirt out of the exposed end 32 of the hydration line 40. Embodiments having said nozzle are provided having a single exposed section 36, shown in FIG. 2, or a cannula 42 with two exposed tubes 42*a* and 42*b*, shown in FIG. 7.

The hydraulic antifreeze fluid 58 may be number of antifreeze liquids found in industry adequate to inhibit the freezing of potable fluid 41, such as high proof alcohol, and may be potable form as an alcoholic beverage, such as vodka. It is understood that such fluid 58 may be a number of chemical additives lowering the freezing point of a water-based liquid and having other colligative properties commonly found in the industry.

In an embodiment of the invention, as shown in FIG. 1, the squeeze bulb 55 (shown in FIG. 2) and the exposed end 32 to the remotely actuated valve mechanism 20 are adapted to be worn by user 11, on a wrist 16 of the user 11 and other secured locations by a fastening means 15. The fastening means 15 may be any number of fastening devices of fabric, leather, rubber or plastic material worn on the user's wrist 16, such as a wrist band secured by Velcro® or provided with snaps, magnets, clamp, band, clasp, tie, buckle or button or a clip to attach said valve mechanism 20 to a shirt or coat. Alternatively, the fastening means 15 could be worn on a different body location of the user 11, or on be incorporated into the user's clothes 17, shown in FIG. 1, such as an outer top layer (such as a coat or jacket) or mid layer garment.

The fastening means 15 in another embodiment comprises a string running from the valve mechanism 20 and looping around a finger, preferably the middle finger, of the user 11, securing the valve mechanism 20 to back of the user's hand. This embodiment would provide the exposed section 36 of the hydration line 30 in an orientation to extend over the cuff of a coat or out the glove of the user 11. It is understood that the fastening means 15 may take other forms.

In an embodiment of the invention, the invention provides a method for dispensing hydration fluids, the elements depicted in FIGS. 1-8. The method comprises adapting a remotely actuated valve mechanism 20 to be worn by a user 11, said mechanism 20 comprising a valve means 14 for controlling potable fluid 41 flowing through said valve mechanism 20. The method provides operationally adapting the valve means 14 to selectively open and close a hydration line 30, centrally locating the actuated valve mechanism 20 along and in fluid communication with the hydration line 30, which is securely attached to and in fluid communication with a hydration reservoir 40 worn by the user 11 and containing the potable fluid 41, and has a reservoir end 31 connected to the hydration reservoir 40 and an opposite exposed end 32 extending outside the user's clothes 17. The method further comprises disposing the hydration line 30 adjacent to the user 11, providing passive heating from the user 11 to the hydration line 30 causing the valve means 14 to be in actuating, cooperative relation with the hydration line 30, allowing potable fluid 41 to move from the hydration reservoir 40 through the actuated valve mechanism 20 and out the exposed end 32, providing the hydration line 30 at the exposed end 32 with a means for clearing potable fluid 37 out of the hydration line 30 proximally from the remotely actuated valve mechanism 20 and through the exposed end 32.

In an embodiment of the invention, the elements depicted in FIGS. 1-6, the method which adapts the remotely actuated valve mechanism 20 comprises defining an interior cavity 12 by a mechanism shell 25 and providing a valve seat 13 projecting into the interior cavity 12 adapted to cooperatively seat the valve means 14, which is operationally adapted to selectively open and close the hydration line 20 at the valve seat 13 against which the valve means 14 is seated when the actuated valve mechanism 20 is operated, and securely locating a pushrod 27 against the valve means 14 at said valve mean's rod side 29, the pushrod 27 having a diaphragm end 28 opposite the rod side 29. A dedicated hydraulic line 50 containing hydraulic antifreeze fluid 58 is adapted to selectively exert fluid pressure against a diaphragm 52 disposed at a mechanism end 53 of the hydraulic line 50 and providing the hydraulic line 50 with an opposite engaged end 54 fixedly secured to a squeeze bulb 55. The dedicated hydraulic line 50 is in pressure exerting, actuating relation against a hydraulic side 56 of the diaphragm 52 when the squeeze bulb 55 is compressed by the user 11, and provides the diaphragm 52 with the hydraulic side 56 operatively disposed within the mechanism end 53 of the hydraulic line 50, an opposite pressure side 57 cooperatively engaging the pushrod 27 at the diaphragm end 28, and having the diaphragm 52 in yielding relation at the pressure side 57 and in pressure-exerting, actuating relation against the pushrod 27 at the diaphragm end 28. This embodiment has the pushrod 27 at the rod side 29 in cooperative relation with the valve means 14, unseating the valve means 14 from the valve seat, allowing potable fluid 41 to move through the actuated valve mechanism 20 into the exposed section 36 of the hydration line 30 and out the exposed end 32. The actuated valve mechanism 20 is in remotely actuating relation with the squeeze bulb 55.

An embodiment of the invention, above, the elements depicted in FIGS. 4-6, providing the method of adapting the valve means 14 of the remotely actuated valve mechanism 20, further comprises adapting a spring-biased ball 21 to selectively open and close the hydration line 30 at the valve seat 13 against which the spring-biased ball 21 is biasedly seated when said valve mechanism 20 is closed, the spring-biased ball 21 having a spring 22 anchored to the mechanism shell 25 at a first end 23 and being disposed against the spring-biased ball 21 at an opposite second end 26. An additional aspect of the invention includes the method of securely locating the pushrod 27 against the spring-biased ball 21 at the rod side 29 circumferentially opposite the spring 22, and cooperatively relating the pushrod 27 at the rod side 29 with the spring-biased ball 21 causing said ball 21 to move against the spring 22 unseating said ball 21 away from the valve seat 13, allowing potable fluid 41 to move through the actuated value mechanism 20 into the exposed section 36 of the hydration line 30 and out the exposed end 32.

An embodiment of the invention, the elements depicted in FIGS. 4-6, provides in the method of dispensing hydration fluids, adapting the remotely actuated valve mechanism 20 to further comprise defining the interior cavity 12 by the mechanism shell 25 and providing the valve seat 13 projecting into the interior cavity 12 which is adapted to cooperatively seat the valve means 14, the valve means 14 operationally adapted to selectively open and close the hydration line 30 at the valve seat 13 against which the valve means 14 is seated when the actuated valve mechanism 20 is operated, thereby operatively disposing the mechanism shell 25 to yield in pressure exerting, actuating relation against the valve means 14 when the mechanism shell 25 is compressed by the user 11, unseating the valve means 14 from the valve seat 13, allowing potable fluid 41 to move through the actuated valve mechanism 20 into the exposed section 36 of the hydration line 30 and out the exposed end 32.

An embodiment of the invention provides a method for adapting the remotely activated valve mechanism 20, wherein adapting the valve means 14 further comprises: adapting the spring-biased ball 21 to selectively open and close the hydration line 30 at the valve seat 13 against which the spring-biased ball 21 is biasedly seated when said valve mechanism 20 is closed, the spring-biased ball 21 having the spring 22 anchored to the mechanism shell 25 at a first end 23 and being disposed against the spring-biased ball 21 at an opposite second end 26; and having the mechanism shell 25 in cooperative relation with the spring-biased ball 21 causing said ball 21 to move against the spring 22 unseating said ball 21 away from the valve seat 13, allowing potable fluid 41 to move through the actuated value mechanism 20 into the exposed section 36 of the hydration line 30 and out the exposed end 32.

Having thus described in detail a preferred selection of embodiments of the present invention, it is to be appreciated, and will be apparent to those skilled in the art, that many physical changes could be made in the device without altering the invention, or the concepts and principles embodied therein. Unless otherwise specifically stated, the terms and expressions have been used herein as terms of description and not terms of limitation, and are not intended to exclude any equivalents of features shown and described or portions thereof. Various changes and modifications can, of course, be made to the preferred embodiment without departing from the spirit and scope of the present invention.

The present invention device, therefore, should not be restricted, except as defined by the following claims and their equivalents.

We claim:

1. A hydration dispensing device, said device comprising:

(a) a remotely actuated valve mechanism adapted to be worn by a user, said valve mechanism comprising a valve means for controlling potable fluid flowing through said valve mechanism;

(b) the valve means operationally adapted to selectively open and close a hydration line;

(c) the remotely actuated valve mechanism being located along and in fluid regulating communication with the hydration line, the hydration line securely attaching to and in fluid communication with a hydration reservoir worn by the user, containing the potable fluid, the hydration line having a reservoir end connected to the hydration reservoir and an opposite exposed end extending outside the user's clothes;

(d) the hydration line is disposed adjacent to the user permitting radiantly provided passive heating from the user to the hydration line;

(e) the valve means being in actuating, cooperative relation with the hydration line, allowing potable fluid to move from the hydration reservoir through the actuated valve mechanism and out the exposed end;

(f) the hydration line containing a means for clearing potable fluid out of the hydration line proximally from the remotely actuated valve mechanism and through the exposed end; and (g) wherein the remotely actuated valve mechanism further comprises:

(i) a mechanism shell defining an interior cavity and providing a valve seat projecting into the interior cavity adapted to cooperatively seat the valve means, the valve means operationally adapted to selectively open and close the hydration line at the valve seat against which the valve means is seated when the actuated valve mechanism is operated;

(ii) a pushrod securely located against the valve means at said valve mean's rod side, the pushrod having a diaphragm end opposite the rod side;

(iii) a dedicated hydraulic line adapted to selectively exert fluid pressure against a diaphragm disposed at a mechanism end of the hydraulic line and the hydraulic line having an opposite engaged end fixedly secured to a squeeze bulb;

(iv) the dedicated hydraulic line sealedly containing hydraulic antifreeze fluid;

(v) the diaphragm having a hydraulic side operatively disposed within the mechanism end of the hydraulic line and an opposite pressure side cooperatively engaging the pushrod at the diaphragm end;

(vi) the hydraulic line being in pressure exerting, actuating relation against the hydraulic side of the diaphragm when the squeeze bulb is compressed by the user;

(vii) the diaphragm being in yielding relation at the pressure side and pressure-exerting, actuating relation against the pushrod at the diaphragm end;

(viii) the pushrod at the rod side being in cooperative relation with the valve means unseating the valve means from the valve seat, allowing potable fluid to move through the actuated valve mechanism into an exposed section of the hydration line and out the exposed end, wherein the exposed end of the hydration line comprises: at least one nozzle; and (ix) the actuated valve mechanism being in remotely actuating relation with the squeeze bulb.

2. The remotely actuated valve mechanism according to claim 1, wherein the valve means comprises:

(a) a spring-biased ball adapted to selectively open and close the hydration line at the valve seat against which the spring-biased ball is biasedly seated when said valve mechanism is closed, the spring-biased ball having a spring anchored to the mechanism shell at a first end and being disposed against the spring-biased ball at an opposite second end;

(b) the pushrod securely located against the spring-biased ball at the rod side circumferentially opposite the spring; and (c) the pushrod at the rod side being in cooperative relation with the spring-biased ball causing said ball to move against the spring unseating said ball away from the valve seat, allowing potable fluid to move through the actuated valve mechanism into the exposed section of the hydration line and out the exposed end.

3. The device according to claim 1, wherein the squeeze bulb and the exposed end to the remotely actuated valve mechanism are adapted to be worn by user and secured by a fastening means.

4. The device according to claim 1, wherein the hydration reservoir comprises: a bladder hydration pack.

5. The device according to claim 1, wherein the means for clearing potable fluid out of the hydration line from the remotely actuated valve mechanism and through the exposed end comprises: an open-ended clearing straw running proximally from the said valve mechanism and out the exposed end.

* * * * *